US007430513B2

(12) United States Patent
Kirkland et al.

(10) Patent No.: US 7,430,513 B2
(45) Date of Patent: Sep. 30, 2008

(54) DATA STORAGE MANAGEMENT DRIVEN BY BUSINESS OBJECTIVES

(75) Inventors: Kyle G. Kirkland, Moorpark, CA (US); Douglas E. Sherman, Simi Valley, CA (US)

(73) Assignee: Baydel North America, Inc., San Jose, CA (US)

( * ) Notice: Subject to any disclaimer, the term of this patent is extended or adjusted under 35 U.S.C. 154(b) by 566 days.

(21) Appl. No.: 10/323,110

(22) Filed: Dec. 17, 2002

(65) Prior Publication Data

US 2003/0097276 A1 May 22, 2003

(51) Int. Cl.
*G06Q 99/00* (2006.01)

(52) U.S. Cl. ..... 705/1

(58) Field of Classification Search ..... 705/1
See application file for complete search history.

(56) References Cited

U.S. PATENT DOCUMENTS

| | | | | |
|---|---|---|---|---|
| 5,287,500 | A | 2/1994 | Stoppani, Jr. | 395/600 |
| 6,185,574 | B1 | 2/2001 | Howard et al. | 707/200 |
| 6,401,183 | B1 | 6/2002 | Rafizadeh | 711/173 |
| 6,415,373 | B1 | 7/2002 | Peters et al. | 711/167 |
| 6,421,711 | B1 | 7/2002 | Blumenau et al. | 709/213 |
| 6,438,642 | B1 | 8/2002 | Shaath | 711/100 |
| 6,920,153 | B2 * | 7/2005 | Ellis et al. | 370/475 |
| 2002/0010708 | A1 | 1/2002 | McIntosh | 707/500 |
| 2002/0026384 | A1 * | 2/2002 | Imanaka et al. | 705/27 |
| 2002/0112113 | A1 | 8/2002 | Karpofff et al. | 711/4 |
| 2002/0116399 | A1 | 8/2002 | Camps et al. | 707/200 |
| 2002/0138477 | A1 | 9/2002 | Keiser | 707/3 |
| 2002/0174306 | A1 | 11/2002 | Gajjar et al. | 711/148 |
| 2003/0135385 | A1 * | 7/2003 | Karpoff | 705/1 |
| 2004/0054675 | A1 | 3/2004 | Li | 707/100 |
| 2004/0078373 | A1 | 4/2004 | Ghoneimy et al. | 707/10 |
| 2004/0088294 | A1 | 5/2004 | Lerhaupt | 707/8 |
| 2004/0093356 | A1 | 5/2004 | Sharpe et al. | 70/200 |
| 2004/0103202 | A1 | 5/2004 | Hildebrand et al. | 709/229 |

OTHER PUBLICATIONS

"Discovery Generic Metadata Set," Prepared by Flare Consultants Limited, Mar. 2002.

Arkivio, "Automating Storage and Data Resource Management with the Arkivio Auto-Stor Software", www.arkivio.com, pp. 1-14.

(Continued)

*Primary Examiner*—Jonathan Ouellette
(74) *Attorney, Agent, or Firm*—Lumen Patent Firm, Inc.

(57) ABSTRACT

Storage organization of data according to business objectives is provided to manage data storage consumption among data storage consumers. Data is not managed at the file level, but organized, coordinated and enforced at a global level based on business logic. The business objectives typically include customer information, priority information, marketing information, manufacturing information, recorded contract and documentary information or information regarding the revenue generation or potential of data. The logical representation enforces data storage consumers to work according to the definitions in the logical representation. The data storage consumers will have the opportunity to define storage parameters for each of the data defined in the logical representation. The placement and determination of where the data should be stored is accomplished according to these defined storage parameters. Data organization based on business logic provides a higher degree of intelligence to the organization of data storage compared to prior art solutions.

2 Claims, 12 Drawing Sheets

OTHER PUBLICATIONS

Arkivio, "Strategies for Improving Return on Investments with the Arkivio Auto-Stor Software", www.arkivio.com, pp. 1-9.
NuView, inc. "Aggregate & Simplify File System Management with NuView StorageX", www.nuview.com.
Chuang et al. "Distributed Network Storage Service with Quality-of-Service Guarantees," Proceedings of the Internet Society INET'99 Conference, Jun. 1999, pp. 1-26.

* cited by examiner

DATA STORAGE MANAGEMENT DRIVEN BY BUSINESS OBJECTIVES

FIELD OF THE INVENTION

The present invention relates generally to data storage management. More particularly, the present invention relates to organizing, coordinating and enforcing data storage management based on associating digital data with business objectives.

BACKGROUND

Increasing efforts in computer automation and digital data processing have resulted in a significant increase of companies' revenues being dependent on computer-generated data and digital end products. For instance, pictures or movies are no longer created and kept in analog format, but they are created, stored and sold in digital format. The creation and exchange of information from databases (e.g. marketing or medical databases) is no longer done in paper copy, but done in digital format. The research and development of products (e.g. semiconductors, cars, airplanes or other sophisticated systems) is highly dependent on computer simulation, processing and manufacturing.

In a large number of the different types of industries, companies tend to generate vast amounts of digital data in a dynamic and continuous fashion when developing products. In all stages of the development, digital data associated with these products needs to be stored and managed. Furthermore, companies tend to generate vast amounts of digital end products as a result of these developments, which also need to be stored so that they can be accessed when purchased by or exchanged with clients.

The dependency on digital processing and digital data is accompanied with an increasing demand in data storage consumption on multiple data storage resources. Furthermore, companies with multiple concurrent projects having a fixed or finite amount of storage space often find themselves with the daunting task of coordinating data storage consumption and use of these data storage devices. Inefficient use of data storage resources often leads to the purchase or acquisition of additional data storage resources, which will compound the data coordination problems due to increased cost and time consumption involved in management (e.g. finding, retrieval etc.), backup and recovery of data on these data storage devices.

An approach to balance cost of data storage with the cost of network performance in a distributed network is discussed by J C Chuang and M A Sirbu in a paper entitled "*Distributed network storage service with quality-of-service guarantees*" and published in the *Proceedings of the Internet Society INET '99 Conference*, June 1999, pp. 1-26. To balance the cost of data storage with the cost of network performance, two techniques are proposed, i.e. caching and replication. The paper by Chuang and Sirbu promotes consuming additional storage by replicating data throughout the network, as opposed to using faster networks with a single copy of data, as a mechanism to meet performance objectives. (See also a product called "*NetCache*" by Network Appliance Inc. published on www.netapp.com/products/#netcache).

In order to better manage data storage from a user or administrator point of view, the prior art teaches different solutions that can generally be classified as two approaches. One prior art approach relates to the abstraction of the multiple data storage devices as one single appearing "virtual" data storage device (See for instance U.S. Pat. No. 6,438,642 assigned to KOM Networks Inc.; U.S. Pat. No. 6,421,711 assigned to EMC Corporation; U.S. Pat. No. 6,415,373 assigned to Avid Technology Inc.; or U.S. Pat. No. 6,401,183 assigned to Flash Vos Inc.). In the art this approach is also referred to as block level virtualization or abstraction and improves the management of the actual storage devices, but not the actual data stored on these data storage devices. Although this approach is beneficial to a system administrator in managing the data storage devices, it gives very little intelligence or knowledge to what data is actually stored on these devices.

Another prior art approach relates to the abstraction of a vast amount of files that are stored on different data storage devices as one single file system (See for instance U.S. Pat. No. 6,185,574 assigned to 1Vision Inc. and NuView Inc. in a paper entitled "*Aggregate and File System Management with NuView Storage X*" and published on www.nuview.com). In the art this is also referred to as file level virtualization. This approach for instance allows servers to share data among different data storage devices. It would provide more intelligence or knowledge than block level virtualization or abstraction, however it would still lack the organization and possibility to coordinate files among the different users at a higher level of intelligence to make important decisions according to business objectives.

Accordingly, there is a need to develop new systems and methods that would allow companies to more efficiently manage and enforce the storage of vast amounts of digital data according to important business decisions and objectives.

SUMMARY OF THE INVENTION

The present invention provides a method and system for managing storage of digital data in a distributed network of data storage consumers and data storage resources according to business decisions and objectives. For the purposes of the present invention, managing storage of digital data encompasses coordinating and enforcing data storage organization among data storage consumers according to a logical representation of business decisions and objectives. The present invention provides a method and system to parse out and define one or more business objectives and organize the digital data according to these business objectives in a logical representation. As such, digital data is not managed at the individual file level, but organized, coordinated and enforced at a global level based on business logic. The logical representation typically includes a hierarchical level description of the digital data. In a particular embodiment, the hierarchical level description includes work types and work units. Work types are used to provide a logical representation for a particular type of digital data such as movie data, music data, real estate data, commercial data, etc. Each work type could represent one or more work units. Each work unit could then represents some of the actual digital data for that work type. In this particular embodiment, the hierarchy of work types classifies and enforces data organization of a particular type of digital data according to the logical representation of work types.

The business objectives typically include customer information, priority information, marketing information or information regarding the revenue generation or potential of digital data. The logical representation enforces data storage consumers to work according to the definitions in the logical representation. The data storage consumers will have the opportunity to define one or more parameters for each of the digital data defined in the logical representation, typically these are the work units. Examples of parameters that could be defined are, for instance, a storage size, user information, security information, priority information, storage location information or storage optimization information. These parameters are defined at the level of the work units or definitions in the logical representation. The placement and determination of where the digital data should be stored is accomplished according to these defined parameters. In one example, the present invention includes means to request storage space for a work unit as it is defined in the logical representation. Such as storage space reservation could then be set aside and guaranteed for the data consumer who requested that storage space. In another example, the present invention includes means to optimize the storage and placement of the digital data one or more data storage resources. The optimization of storage could be accomplished based on different optimization objectives such as, for instance, minimizing the overall network traffic performance, optimizing to the capacity of one or data storage resources, optimizing to the performance of one or more data storage resources, optimizing to satisfy a requested storage size for digital data in the logical representation, optimizing to satisfy a requested storage location for digital data in the logical representation or optimizing to minimize processing time for digital data in the logical representation. The logical representation provides a more intelligent way of organizing digital data. Where the data is placed on the data storage resources is basically "invisible" to the data storage consumer. A map is included that abstracts the physical locations of the storage of the digital data, which corresponds to the defined logical representation to provide means for the system to store and retrieve the digital data.

In view of that which is stated above, it is the objective of the present invention to provide a new method to dictate of how digital data storage organization should be accomplished according to business objectives.

It is still another objective of the present invention to represent business logic in the organization of digital data storage.

It is still another objective of the present invention to provide a digital data organization that provides a level of intelligence from which business or project decisions can be easily made.

It is still another objective of the present invention to manage digital data from a logical representation based on business objectives.

It is still another objective of the present invention to enforce data storage consumers to store digital data according to a logical representation based on business objectives.

It is still another objective of the present invention to provide data storage consumers with the flexibility to define parameters at the level of a logical representation based on business objectives.

It is still another objective of the present invention to request storage space according to a logical representation based on business objectives.

It is still another objective of the present invention to optimize storage space on data storage resources according to a logical representation based on business objectives at the level of data storage consumers.

The present invention is advantageous by providing a higher degree of intelligence to the organization of data storage compared to prior art solutions. It will promote a more efficient use of data storage resources in a network of data storage resources as well as an efficient data processing workflow for the data storage consumers. The present invention could yield an increased business production with a fixed amount of storage resources and control and containment of future storage consumption. Furthermore, the present invention simplifies the task of system administrators and the "marshalling of data" tasks. Routine storage related tasks resulting from data storage consumer requests, such as, setting up, moving and administration of partitions as defined in the parameters could now be automated. The present invention could be implemented as an external structure layered on top of existing computer and software system structures without adding any additional investments.

BRIEF DESCRIPTION OF THE FIGURES

The objectives and advantages of the present invention will be understood by reading the following summary in conjunction with the drawings, in which.

DETAILED DESCRIPTION OF THE INVENTION

Although the following detailed description contains many specifics for the purposes of illustration, anyone of ordinary skill in the art will readily appreciate that many variations and alterations to the following exemplary details are within the scope of the invention. Accordingly, the following preferred embodiment of the invention is set forth without any loss of generality to, and without imposing limitations upon, the claimed invention.

Figure 1:
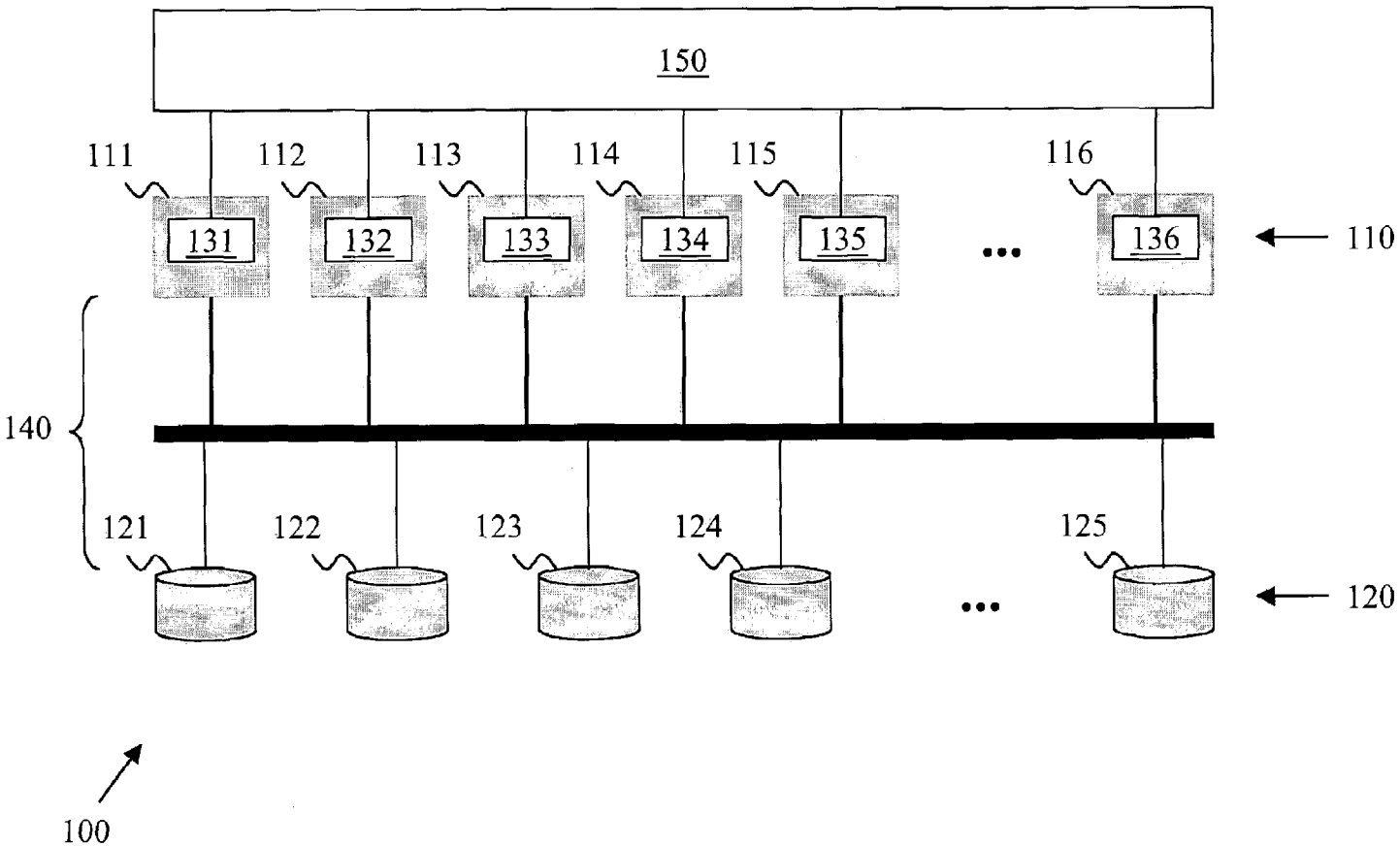
FIG. 1 shows a distributed network system according to the present invention.

FIG. 1 shows a distributed network system 100 with data storage consumers 110 and data storage resources 120 according to the present invention. Distributed network system 100 could include one or more data storage consumers 111-116 which could be any type of consumer that generates, processes or manages digital data that requires storage. For instance, a data storage consumer could be an engineer, system administrator, project manager or any type of person that is involved in the consumption of data storage. A data storage consumer typically interacts with a hardware device (not shown) such as, but not limited to, a computer system, file server or any type of means that is capable of processing digital data such as desktop computers, handheld computers or wireless devices that are connected to distributed network system 100. Each hardware device typically includes a software means 131-136 (such as an operating system software and application(s) software) that assists the data storage consumer in working with digital data on the hardware device as is common and available in the art.

Distributed network system 100 also includes one or more data storage resources 121-125 which typically include any type of optical or magnetic storage means as they are common and available in the art. The number of data storage resources could be same or could be different from the number of data storage consumers. Typically the number of data storage devices depends on the amount of digital data that needs to be stored once it has been generated by the data storage consumers as well as by the amount of investment a company wants or is capable to make. However, one of the objectives of the present invention is to better and more efficiently manage data storage resources amongst data storage consumers and reduce unnecessary purchases of data storage resources by more intelligently managing digital data. How digital data will be organized and assigned to the data storage resources is discussed infra.

An information technology (IT) structure 140 is typically included in distributed network system 100 to allow data storage consumers 111-116 to up/down-load data to/from data storage resources 121-125. IT structure 140 refers to the necessary "plumbing" that is associated to deploying a network infrastructure, which is known in the art and readily available technology.

There are typically two types of digital data generated by the data storage consumers that needs to be stored on data storage resources. The first type of data could be classified as static data such as a final end product that is ready for sale or shipment to the customer. One could also consider, for instance, but not limited to, an invoice, a letter, a contract, or recorded minutes as a type of static data. The second type of data could be classified as dynamic data such as data related to R&D or product. One could also consider, for instance, but not limited to, dynamic data that flow in an attorney practice, a bank, an insurance company, oil company, or the like development whereby intermediate stages of the development requires storage of data. The present invention is associated with both the static and dynamic type of data when it comes to data storage management. In either case, one or more data storage consumers generate vast amounts of digital data that needs to be stored on one or more data storage resources.

Logical method 150 in FIG. 1 is the method of the present invention that coordinates, manages and enforces data storage of these vast amounts of digital data based on a logical representation of the digital data. Logical method 150 is implemented at the level of the data storage consumers 110 in such a fashion that data storage consumers would need to comply with a logical representation of the data before they can continue with a data storage action or request. Logical method 150 is layered with the software applications 131-136 as shown in FIG. 1. Also, method 150 is layered before the file/compute server(s) to promote a better organization of data storage and enforce such a better organization at the level of the data storage consumers.

Figure 2:
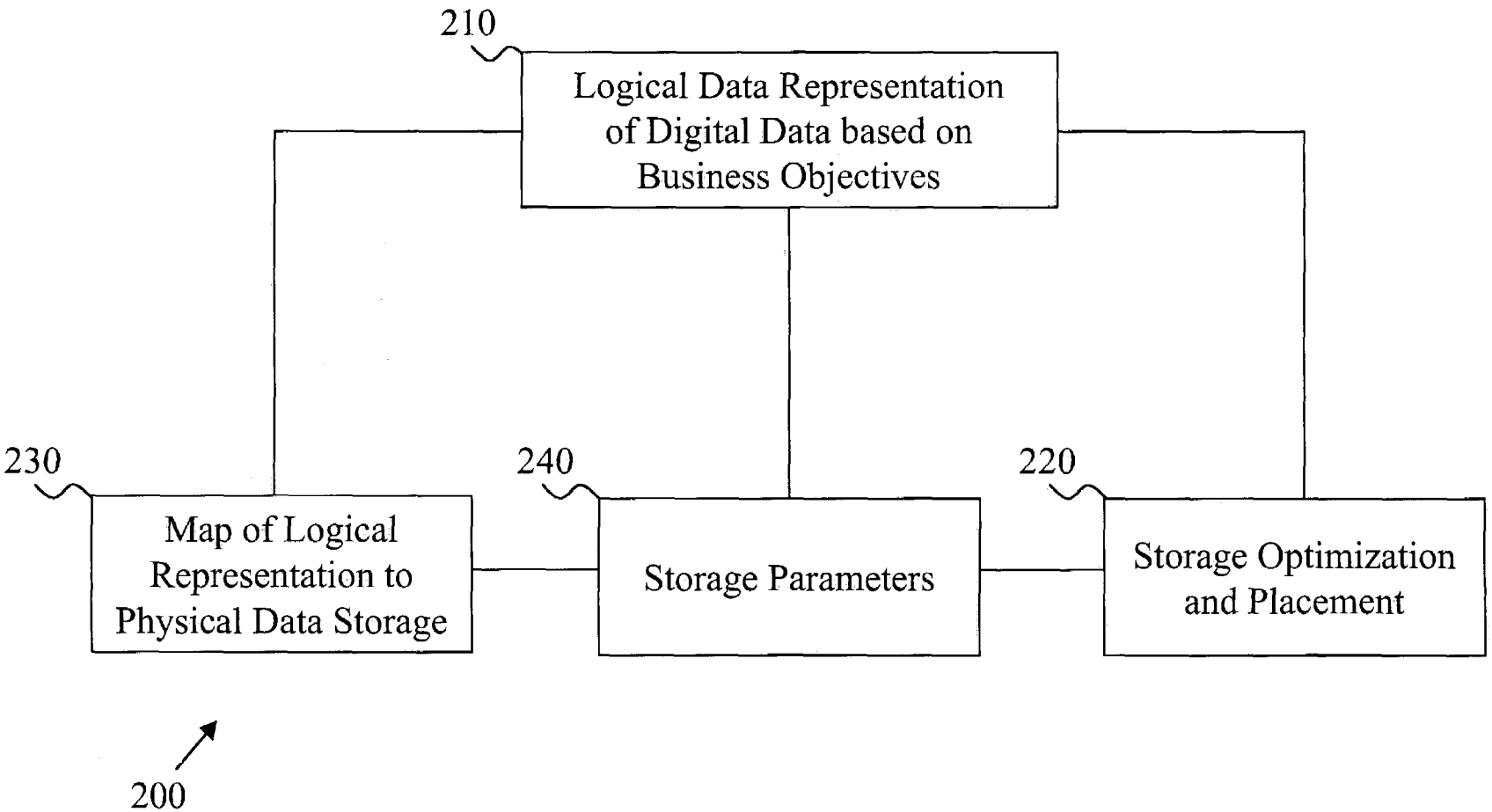
FIG. 2 shows a preferred embodiment of the method according to the present invention.

Now what is meant by the logical representation of digital data and who establishes such a logical representation for the digital data? FIG. 2 shows an example of a preferred embodiment 200 according to the method of the present invention. The concept introduced here in the present invention is to parse out and define 210 one or more business objectives and organize the digital data according to these business objectives. In other words, digital data is not managed at the individual file level, but organized, coordinated and enforced based on a global level of business logic. The intelligence of how a business is managed and organized or what is important to a business is hereby translated into the organization of digital data that is to be stored. For instance, at a higher level of a company, e.g. by business managers or project managers, it is decided what products or developments are crucial or relevant for the business in terms of revenue generation or potential, client portfolio(s) or market positioning. Identifying these products or developments is the start of defining a logical representation for digital data whereby business value of digital data is abstracted from the data storage resources. Accordingly, the logical representation distinguishes between relevant data and data that is less relevant to a business, in particular junk or personal data generated by data storage consumers. In addition, data storage consumers are enforced to work according to the definitions of the logical representation.

Now important to note is that instead of providing a data storage consumer with a map of the physical location and placement 220 of the digital data on the data storage resources, the data storage consumer is presented with the logical representation of the digital data as defined based on business logic—which are two different things. The physical location map could represent the digital data to be scattered all over the available data storage resources or scattered over just a few. The logical representation now represents a concise and transparent way of data organization according to the (immediate) needs in a company. The physical location and placement 220 of where the digital data is actually stored is independent from the logical representation as long as a map 230 exists between the logical representation of the digital data and the actual physical placement of the digital data, which allows for the digital data to be placed and retrieved according to the organization of the logical representation defined 210 for the digital data. The actual placement 220 of digital data, which could be arranged and optimized according to several storage parameters 240, is discussed infra.

Understanding the primary concept of translating and organizing digital data in a logical representation from the perspective of a business organization, a person of average skill in the art to which the present invention pertains would readily acknowledge that the logical representation could include several different business as well as project objectives. Furthermore, the logical representation could also include a representation based on customer/client information (e.g. important or emerging clients), priority information (e.g. high or low priority data/customers) or marketing information (e.g. different market or target groups). A variety of different logical representations could be defined each with a different level of sophistication, but each definition starts at a high and global level taking into account the business value of digital data, which tends be far more abstract than the specific details of individual data files.

An example of defining a logical representation is presented in relation to digital movie data for a movie producing company, which digitally produces masters and/or sells digital movies. The development and storage of these digital masters/movies is therefore considered to be important for the movie producing company, for instance from the point of being a revenue source. In light of the present invention, digital movie data could then be defined at the highest level of the logical representation. Other examples of defining digital data at such a higher level could, for instance, be digital music data, digital video data, digital data related to manufacturing design, to real estate details, to contractual, accounting and inventory records and many other forms of digital data related to commercial aspects of a business. However, the present invention is not limited to these particular examples of digital data.

Figure 3:
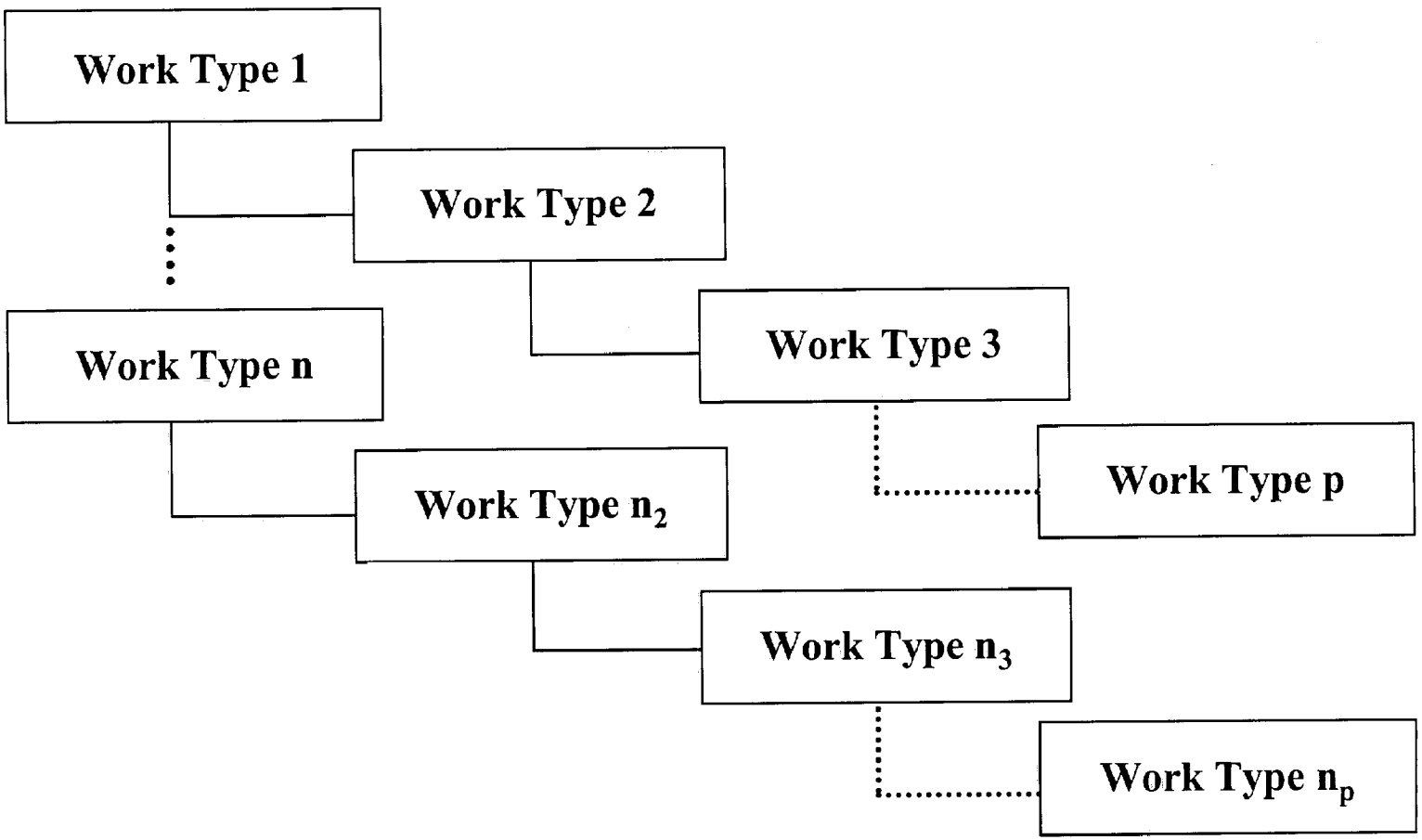
FIGS. 3-9 show different examples of defining a logical representation according to the present invention.

Once the highest level of the logical representation is defined it could then be referred to as a work type as shown in a preferred embodiment in FIG. 3. FIG. 3 shows work type 1 to n each representing for instance different movies. Each work type such as work type 1 could include a hierarchical organization of work types such as work type 2 to p. Accordingly, work type n could include a hierarchical organization of work types such as work type 2 to p. In the example of FIG. 3 work type 1 to n are similar hierarchical organizations that could then be used for the same type of digital data or digital data classification as defined at the highest level, e.g. digital movie data. The hierarchy of work type templates then classifies and enforces data organization of a particular type of digital data according to the logical representation of work types.

Figure 4:
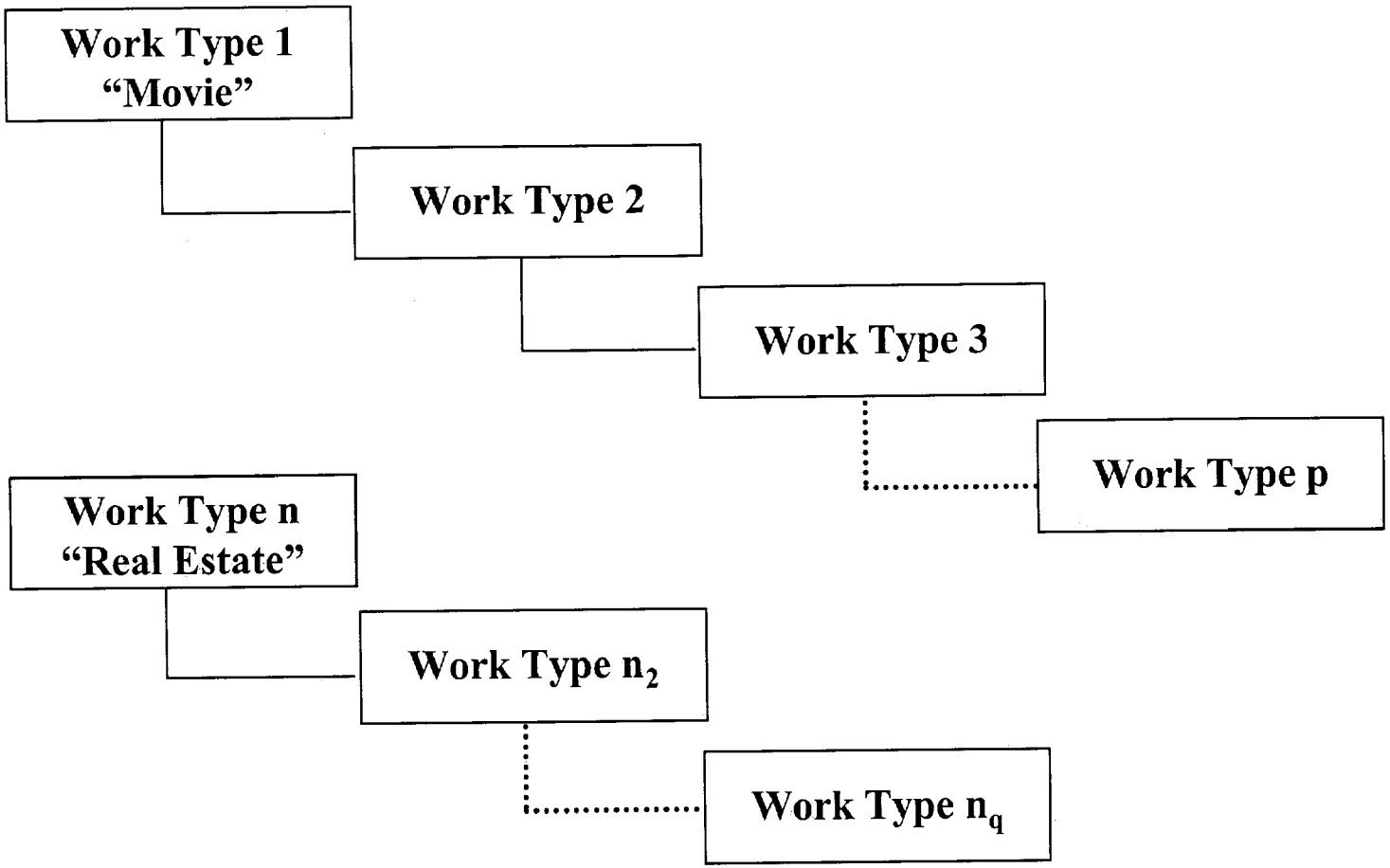
Figure 5:
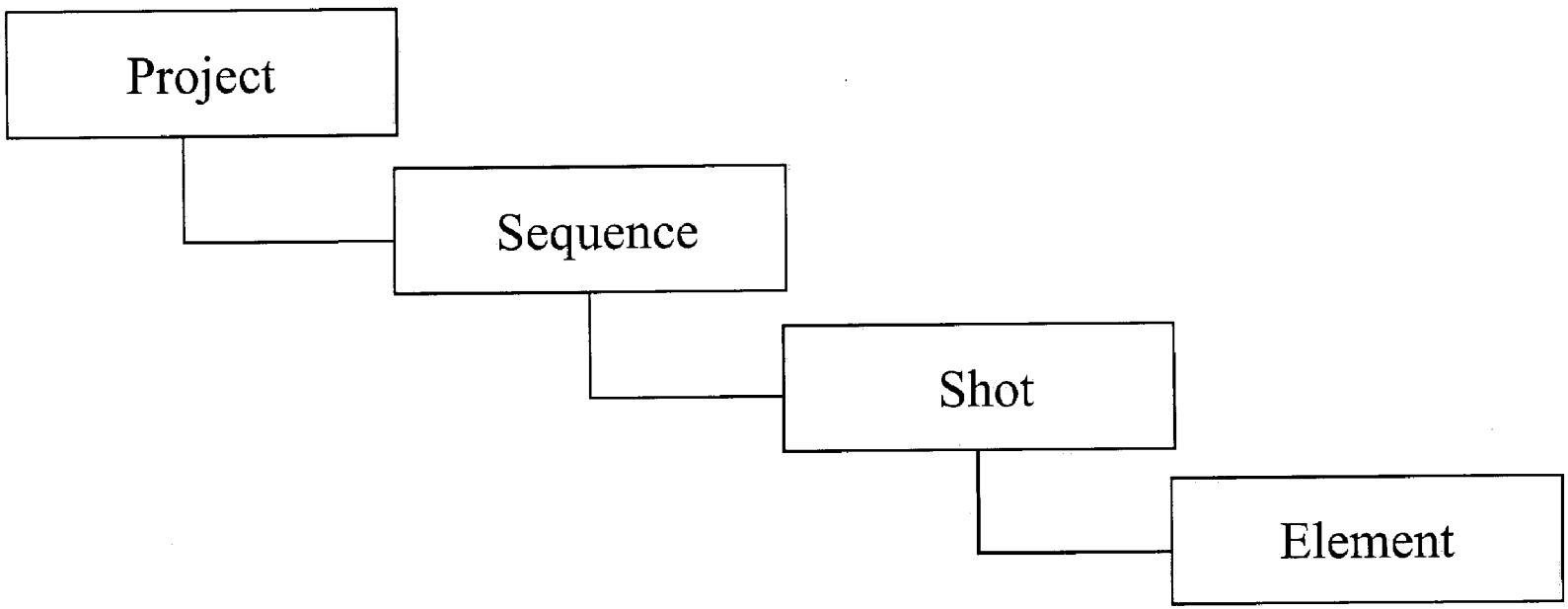
Figure 6:
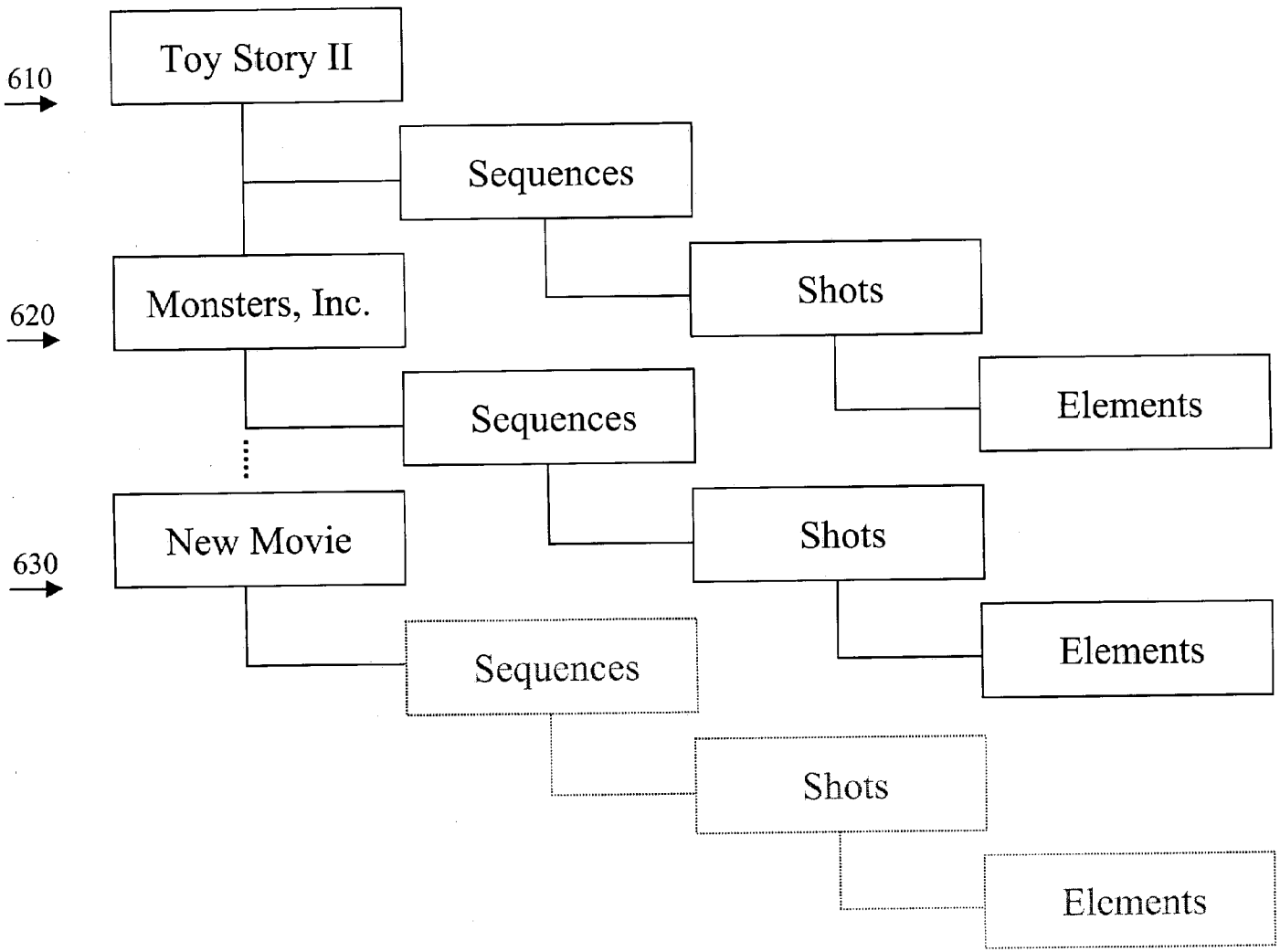

For other type of digital data, such as digital real estate data, the hierarchical organization of work types might be different. As shown in FIG. 3, digital movie data could for instance be organized according to p levels of work types, whereas, digital real estate data could for instance be organized according to q levels of work types as shown in FIG. 4. The number of levels of work type templates is dependent on the definition of the logical representation for a particular type of digital data. FIG. 5 shows a more specific example of a hierarchy of work types for the example of digital movie data for the movie producing company. Referring to FIGS. 3 and 5 respectively, "work type 1" is called "project", "work type 2" is called "sequence", "work type 3" is called "shot" and "work type p" (whereby p=4) is called "element". As a person of average skill in the art would readily acknowledge, the work type n in FIG. 3 would have a similar organization of project, sequence, shot and element but now for a different movie. FIG. 6 shows a specific example of multiple work units 610-620 for respectively Toy Story II and Monsters Inc., which are actual movies digitally mastered and produced by Pixar Inc. and Disney Inc. according to the work types as defined in FIGS. 3 and 5. The list of movies is of course not limited to just two and could be as extensive as is necessary based on the business objectives. For instance, the movie producing company may decide to explore a new venture in relation to a New Movie and the company decides to define the New Movie as new work units 630 in the logical representation. Note that work units 630 have the same hierarchical organization of work types as for work units 610-620.

Figure 7:
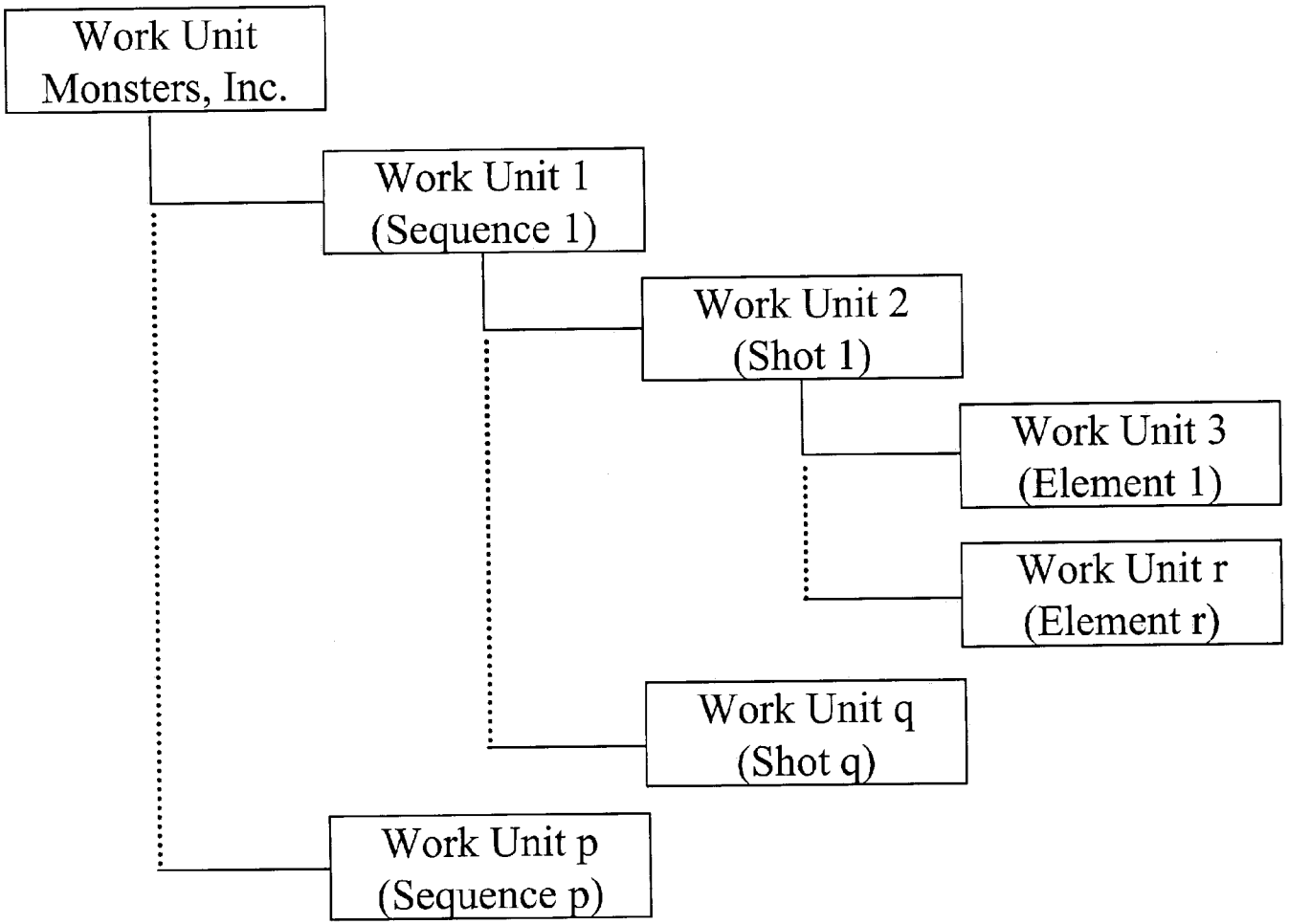

In the preferred embodiment according to the present invention, one or more work units represent each work type. Each work unit represent some of the actual digital data for that work type as shown in FIG. 7 for the digital movie data Monsters, Inc. of the movie producing company. Referring to FIGS. 5 and 7 respectively, project is called "Monsters, Inc." and includes "sequences" 1 to p, "shots" 1 to q and "elements" 1 to r, whereby p, q and r are typically large numbers.

Figure 8:
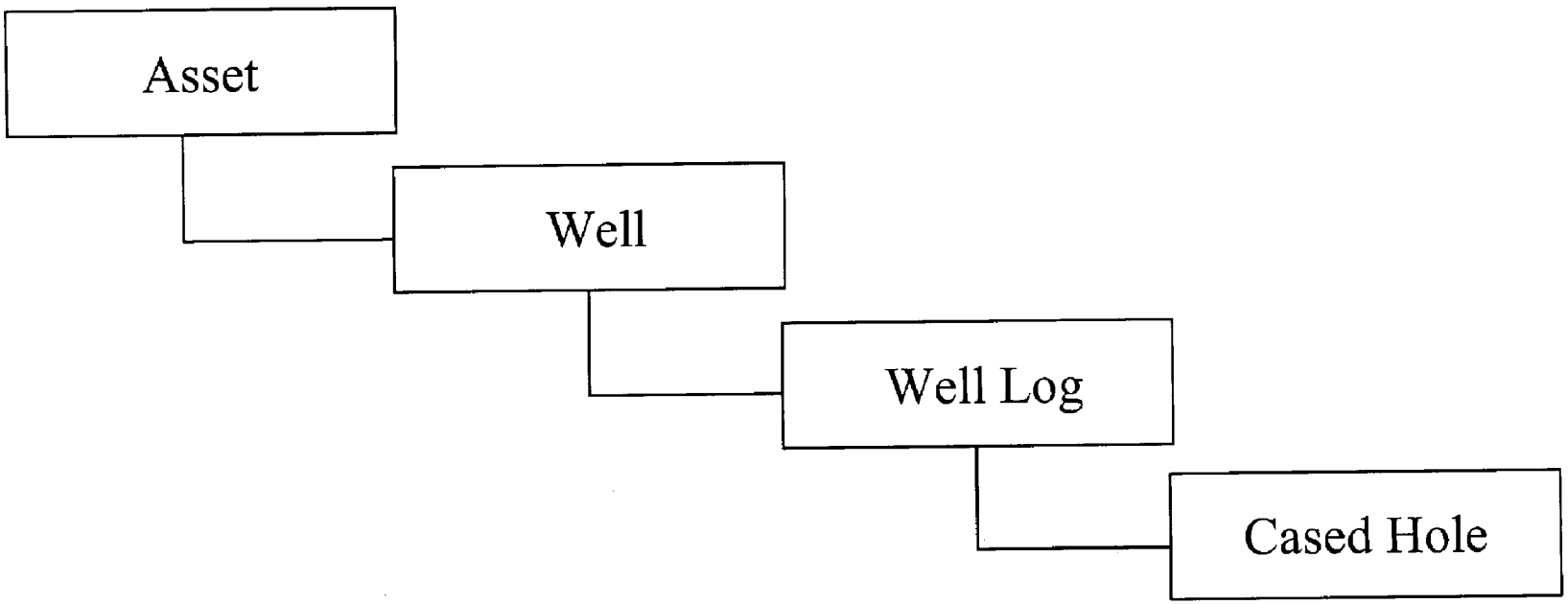
Figure 9:
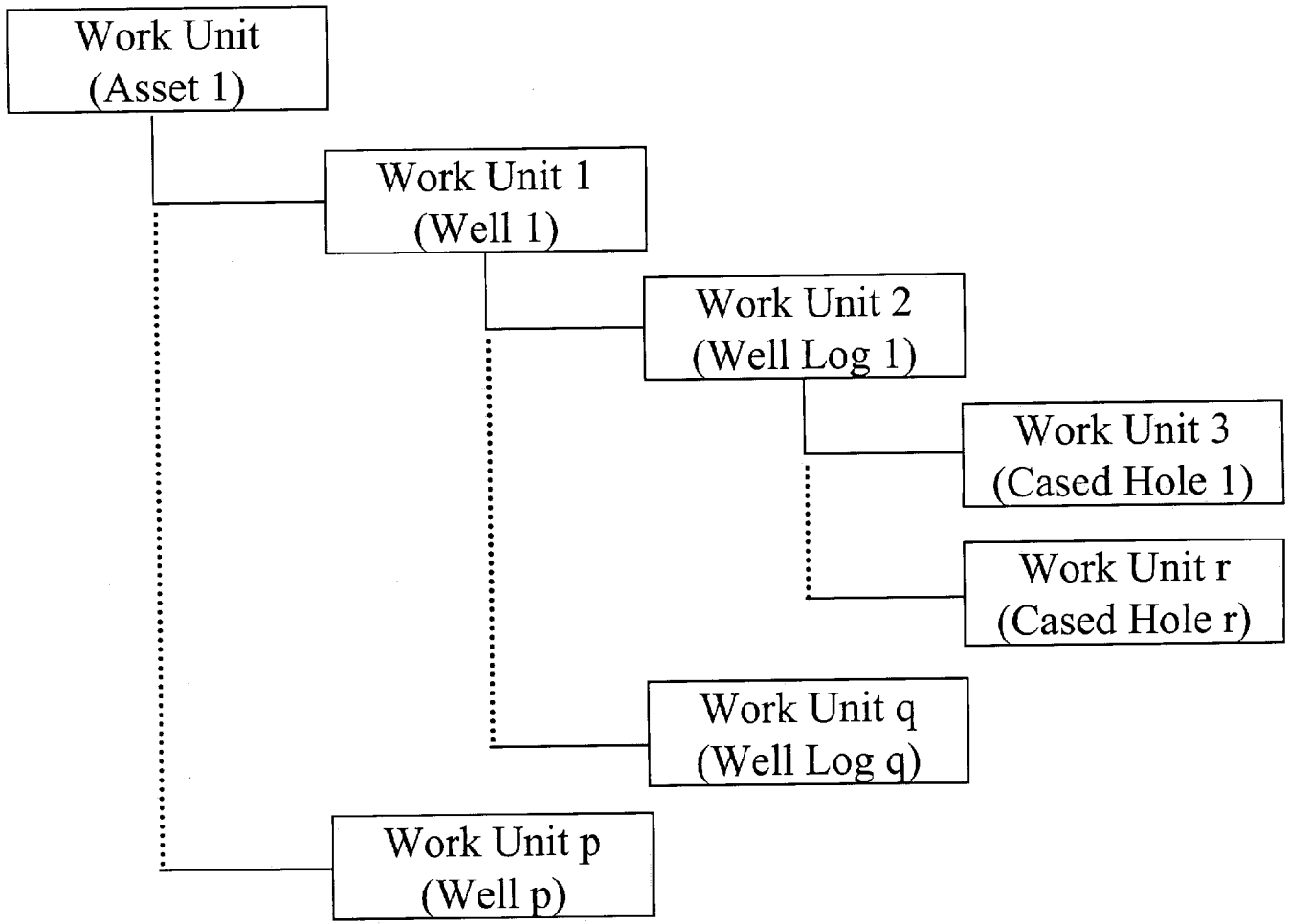

FIG. 8 provides an example of one or more work types related to digital data for an oil company. In this example, one could for instance distinguish "asset" as "work type 1", "well" as "work type 2", "well log" as "work type 3" and "cased hole" as "work type 4" if one considers the example of work types shown in FIG. 3. Accordingly, one could define "field" or "license" at the level of "work type 2", "rock/core", "equipment", or "fluid" at the level of "work type 3", and/or "casing" at the level of "work type 4". A person of average skill in the art would readily appreciate that these are merely examples of an organization of work types for digital data of an oil company and that there could be different variations based on the business objectives. FIG. 9 shows an example of one or more work units according to the example of work types of FIG. 8. Respectively, "asset 1" is a work unit of work type "asset" and includes "wells" 1 to p, "well logs" 1 to q and "cased holes" 1 to r, whereby p, q and r are typically large numbers.

In defining a logical representation one should bear in mind that it is not necessary and not the purpose of the present invention to describe the entire tree of how data is organized and built.

Again the business value of data is abstracted from the digital data and represented at a higher level of work types. Therefore, it would typically be sufficient to define a logical representation at the level of a reasonable small amount of work types. In some cases where the business objectives could be more complex, if might be helpful to define more work types. However, a logical representation would never be described at each individual file. The idea of the present invention is that once a logical representation for digital data is defined at such a higher level, the other components or files associated with the defined digital data in the logical representation would be automatically included since they typically follow a hierarchical order. For instance, if a data storage consumer defines storage parameters for a work unit as defined in the logical representation, these parameters will then be automatically defined for all the digital data that is directly related to that work unit. In other words, a data storage consumer does not have to worry about defining storage parameters for all the individual files related to a work unit or finding the best storage placement for the digital data (this is discussed in more detail infra).

Once the logical representation is defined, data storage consumers will then be enforced to organize the storage of digital data according to these definitions. However, once a logical representation is defined, it would be still be allowed to make changes by, for instance, adding work units, deleting work units, renaming work units, etc. Such a process of dynamically modifying the logical representation has become a transparent task since these changes are now based on decisions made at a higher and more abstract level of data organization, which originates from the business and management of a company. Therefore, it would always be possible to change the level of sophistication of the logical representation organization according to new or changing business objectives.

Referring back to FIG. 2, the preferred embodiment of the method 200 of the present invention includes means to define one or more storage parameters 240, i.e. that once a logical representation has been defined, for instance for a number of work units, a data storage consumer could define storage parameters 240 for each of the work units as they are defined in the logical representation. These storage parameters allow a user or a data storage consumer to store the data with a certain degree of quality and flexibility for the defined logical representation. Storage parameters that could be defined for a work unit are, for instance, but not limited to, a storage space request to provide the flexibility to find the appropriate storage size for a work unit, a variety of different optimization parameters related to balancing and placing the data on the data storage resources as well as user information, security information, priority information, and other storage preferences including a special request to pool certain data, e.g. sensitive data or data to match a workflow, on a data storage resource with particular characteristics.

One of the storage parameters data storage consumers could define is a storage space request using, for instance, a storage reservation management system that is included in the method of the present invention to facilitate the storage consumer's ability to dynamically adapt to such changing business objectives/requirements. For instance, each storage consumer could request a storage reservation for the work unit (s)he is working on. For instance, a data storage consumer could make a request to reserve storage space as large as 50 Gigabytes for work unit "Monsters, Inc.". Another data storage consumer could request to reserve storage space as large as 100 Gigabytes for work unit "New Movie". Such a reservation is then made at the level of the work unit and would provide a guaranteed place-holder for storage space for that data storage consumer. Once a reservation is made, it could be validated, after which a virtual mount point could be created for this reservation. A virtual mount point is the logical location, which abstracts the storage consumer from the physical storage location, i.e. map 230 as shown in FIG. 2. The purpose of the present invention is to enforce data storage consumers to make the storage reservations at the higher level, which are typically the work units. That way, as mentioned above, data storage consumers do not have to worry about defining parameters for all the individual files related to the work unit. The storage reservation management system could also include all means to allow a data storage consumer to resize a storage request or validate a storage request to determine whether the request was in an acceptable range or validated according to the business objectives.

Figure 10:
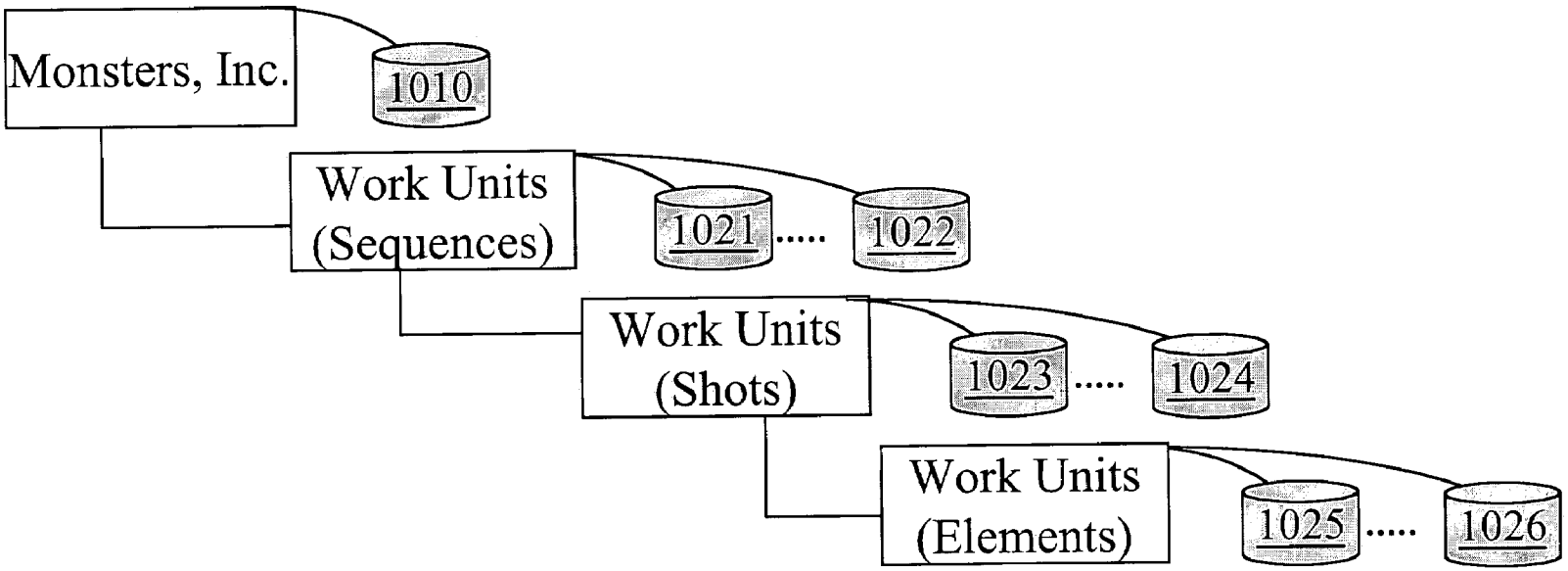
FIG. 10 shows an example of how digital data could be placed on one or more data storage resources according to the present invention.

One of the other storage parameters data storage consumers could define is one or more optimization parameters using, for instance, a storage optimization or balancing system 220 that is included in the method of the present invention as shown in FIG. 2 to facilitate how best to place and store the digital data on the data storage resources. A data storage consumer could either predefine optimization parameters when the logical representation is created or add these at a later stage. Storage optimization or balancing system 220 optimizes the storage and placement of the digital data according to these optimization parameters. It should be realized that logical representation typically defines a higher level of organization of the digital data, whereas in reality there are still a large numbers of files as shown in an example according to movie data Monsters, Inc. in FIG. 10. For example, the entire assembly of the movie Monsters, Inc. (defined in logical representation as a work unit) could be stored on data storage resource 1010, whereas the individual components (not explicitly defined in logical representation) that make up the movie could all be stored on the same or different data storage devices 1021-1026. Now how to best distribute or balance the digital data associated with a work unit is the task of the storage optimization or balancing system 220. Storage optimization or balancing system 220 would be able to determine such placement according to well established means (i.e. algorithms or methods) that are available in the art to calculate or determine the best match of storage resources based on the data storage consumer's request provided through the optimization parameters 240. For instance, for a certain project it might be required to minimize the overall network traffic performance. In that case, an optimization parameter 240 is defined for the digital data of that project. The storage optimization or balancing system 220 then either has a model of the IT structure and knows the fastest network path to one or more data storage resources or might have to calculate or investigate this by means that are common in the art. Once such data storage resources are identified by the storage optimization or balancing system 220, the digital data could be placed on the data storage resources that provide the fastest network connection for data storage. For another project one might be concerned about the capacity or performance (speed, reliability, cost, etc.) of the data storage resources or ensuring that a requested storage size for the digital data, is satisfied. In all these examples, storage optimization or balancing system 220 will optimize according to the defined optimization parameters 240 and balances the digital data on the data storage resources.

Figure 11:
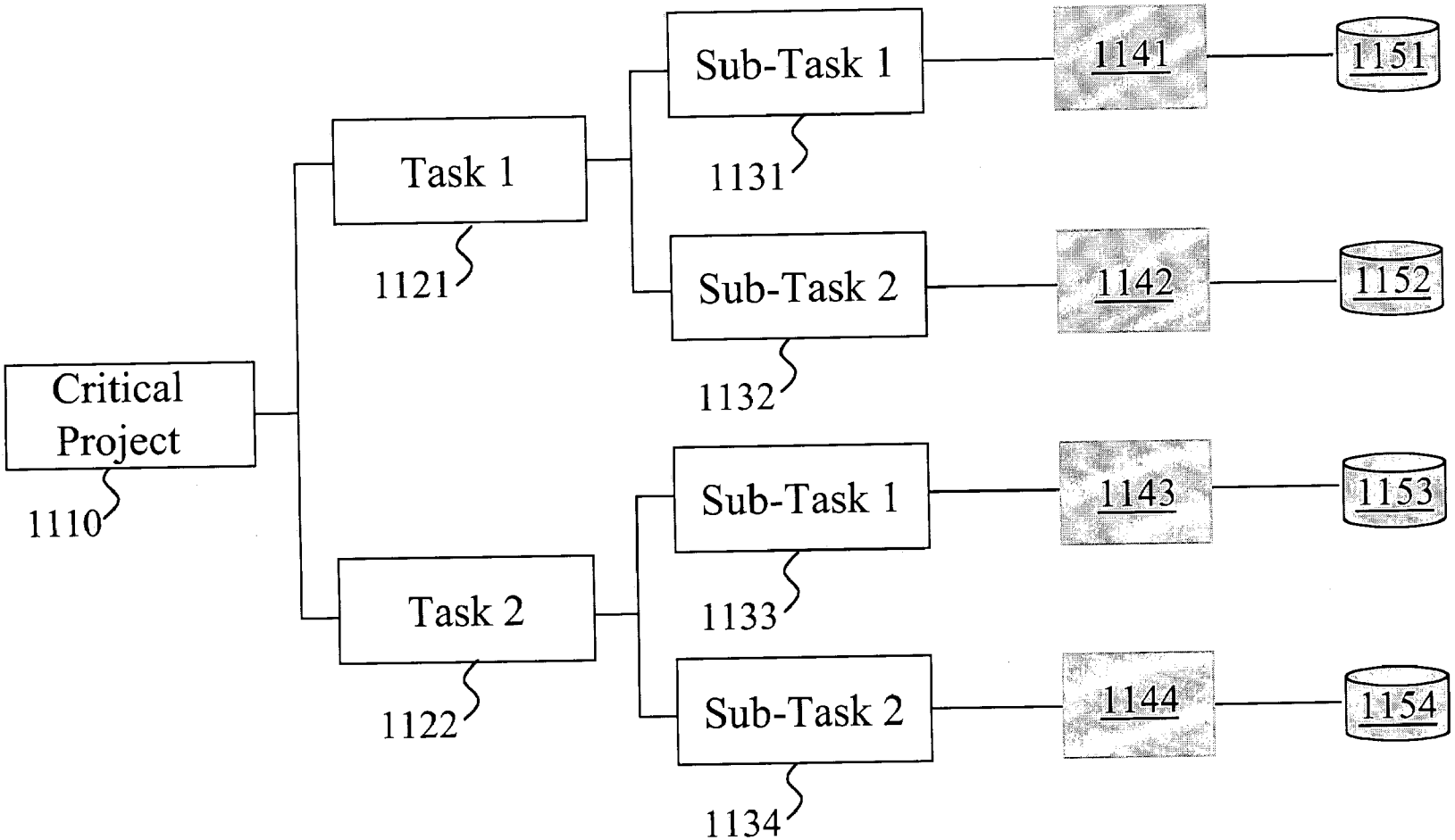
FIG. 11 shows an example of optimizing data storage based on minimization of processing time according to the present invention.
Figure 12:
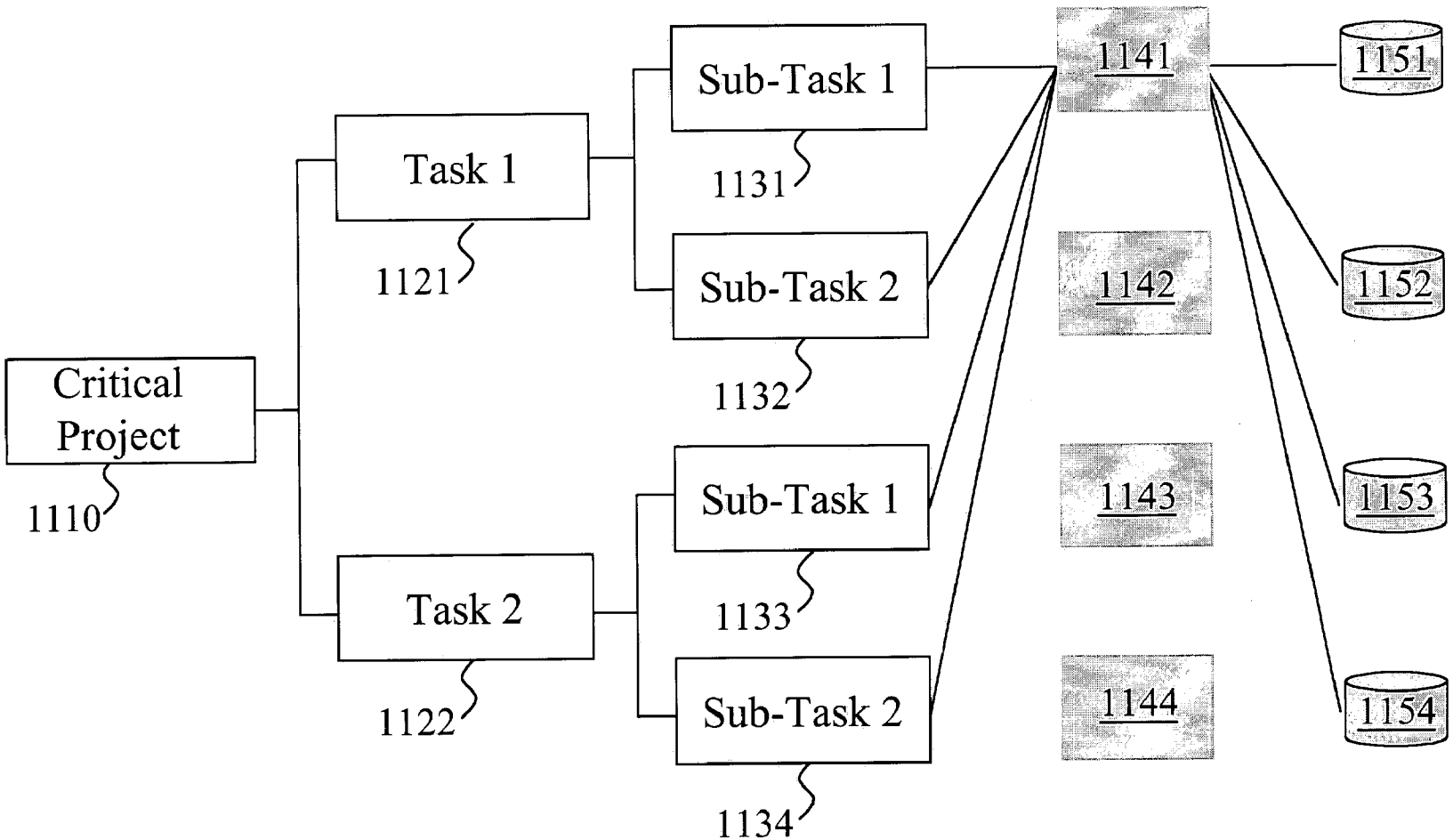
FIG. 12 shows an example of optimizing data storage based on minimization of network transfers of digital data according to the present invention.

Yet another way of optimizing the digital data is to minimize the processing time. For instance, there might be critical projects 1110 that contain tasks 1121-1122 each with several sub-tasks 1131-1134 that require lots of computer processing time and/or storage space (See FIG. 11). In such a case, the optimization parameters could be set that, for the processing of the sub-tasks 1131-1134, individual file/compute resources 1141-1144 are reserved to operate in parallel, i.e. each sub-tasks 1131-1134 is processed on an independent file/compute resource 1141-1144 utilizing individual data storage resources 1151-1154, respectively. Now once the sub-tasks are processed and sub-tasks 1131-1134 are ready for reassembly, the optimization parameters could be set or adjusted such that all data related to the sub-tasks 1131-1134 are moved back to one file/compute server 1141 as shown in FIG. 12.

The present invention has now been described in accordance with several exemplary embodiments, which are intended to be illustrative in all aspects, rather than restrictive. Note that the examples were provided with a certain degree of simplicity rather than complexity to better illustrate the concept of the present invention and these examples should not be regarded as limiting to the spirit and scope of the present invention. Thus, the present invention is capable of many variations in detailed implementation, which may be derived from the description contained herein by a person of ordinary skill in the art. For instance, the method of the present invention is preferably a computer-implemented method whereby a program storage device (i.e. a computer program or executable) is accessible by a computer. The computer-implemented method embodies a program of instructions executable by the computer to perform the method steps for managing storage of digital data as discussed supra. The preferred type of computer language to code the program of instructions is one that is computer platform independent so that the present invention could be used on any type of computer system, framework or infrastructure. However, the present invention could be coded with any type of programming language and is not limiting to a particular kind. Furthermore, the method of the present invention could include any kind of user interface (e.g. command line, graphical user interface, or the like) to interact with a user or data storage consumer. In addition several off-the-shelf databases (for instance, but not limited to, MySQL) or industry file standards could be used to establish map 230 and the necessary infrastructure to manage file systems (for instance, but not limited to, POSIX or NTFS.) according to the present invention. The method of the present invention could also include a variety of different means that allows the data storage consumer to review the logical representation and its performance regarding storage consumption, such as reviewing defined work units, reviewing the reserved and used storage space, reviewing the defined parameters for the work units, reviewing data defined as pooled data, reviewing data storage resource partitions, etc. The means to review all such information could be established by a graph, a table, formatted display on a computer screen, or the like. Furthermore, the system of the present invention could be different from a network of data storage consumers and data storage resources. For instance, the present invention of managing data storage of digital data according to a logical representation based on business logic would be beneficial to data storage consumer using a single computer or a small number of computer devices with one or a few data storage resources available. All such variations are considered to be within the scope and spirit of the present invention as defined by the following claims and their legal equivalents.

What is claimed is:

1. A method for organizing folders on and reserving digital data storage space from a distributed network of data storage resources for digital data storage consumers, comprising:

(a) defining a multi-tiered tree-like framework of a logical hierarchical representation of descriptive nodes defined as work types having nested therewith sub-work types, said logical hierarchical representation is defined to reflect a company's desired folder hierarchy structure based on one or more business objectives parsed from a database of company records and defined as business products and/or business developments and integrated into said logical hierarchical representation, and said logical hierarchical representation is an enforced template for a folder hierarchy structure for reserving said data storage space and for organizing said digital data according to said one or more business objectives defining said logical hierarchical representation, wherein each of said work types (i) provides a hierarchical point from which said nested sub-work types are related and where said digital data is organized, wherein said sub-work types relation and organization is in accordance with said logical hierarchical representation defined by said one or more business objectives for the combination of said work types and its respective nested sub-work types (ii) provides attributes to define which level of said folder hierarchy structure relates to said reservation of said digital data storage, (iii) provides default data size values for said digital data storage space, (iv) pre-defines folder names for said folders related to said work types, and (v) automates definition of said folder hierarchy structure;

(b) defining for each of said work types a plurality of work units acting as an abstracted reference to one or more of said physical folders on said distributed data storage resources, wherein each of said work units is constrained by said defined logical hierarchical representation of said plurality of work types and the respective constraints for each of said work types in terms of said pre-defined names, and said data size values;

(c) determining the location and physical structure of said folders for said reserved storage space on said distributed network of data storage resources based on availability and load optimization, and wherein said physical folders are created based on said steps (i), (ii) and (iii); and (d) constraining said data storage consumers to stay within the defined boundaries of said physical folder structure governed by said folder hierarchy structure of said work units and said data size values, and taking action when said boundaries are breached.

2. A program storage device accessible by a computer, tangibly embodying a program of instructions executable by said computer to perform method steps for organizing folders on and reserving data storage space from a distributed network of data storage resources for data storage consumers, comprising the method steps of:

(a) defining a multi-tiered tree-like framework of a logical hierarchical representation of descriptive nodes defined as work types having nested therewith sub-work types, said logical hierarchical representation is defined to reflect a company's desired folder hierarchy structure based one or more business objectives parsed from a database of company records and defined as business products and/or business developments and integrated into said logical hierarchical representation, and said logical hierarchical representation is an enforced template for a folder hierarchy structure for reserving said data storage space and for organizing said digital data according to said one or more business objectives defining said logical hierarchical representation, wherein each of said work types (i) provides a hierarchical point from which said nested sub-work types are related and where said digital data is organized, wherein said sub-work types relation and organization is in accordance with said logical hierarchical representation defined by said one or more business objectives for the combination of said work types and its respective nested sub-work types (ii) provides attributes to define which level of said folder hierarchy structure relates to said reservation of said digital data storage, (iii) provides default data size values for said digital data storage space, (iv) pre-defines folder names for said folders related to said work types, and (v) automates definition of said folder hierarchy structure;

(b) defining for each of said work types a plurality of work units acting as an abstracted reference to one or more of said physical folders on said distributed data storage resources, wherein each of said work units is constrained by said defined logical hierarchical representation of said plurality of work types and the respective constraints for each of said work types in terms of said pre-defined names, and said data size values;

(c) determining the location and physical structure of said folders for said reserved storage space on said distributed network of data storage resources based on availability and load optimization, and wherein said physical folders are created based on said steps (i), (ii) and (iii); and (d) constraining said data storage consumers to stay within the defined boundaries of said physical folder structure governed by said folder hierarchy structure of said work units and said data size values, and taking action when said boundaries are breached.

* * * * *